United States Patent [19]

Doughty et al.

[11] Patent Number: 4,650,272

[45] Date of Patent: Mar. 17, 1987

[54] CIRCUIT BREAKER LINE TERMINAL SCREW RETAINER

[75] Inventors: Dennis J. Doughty; Raymond K. Seymour, both of Plainville; Ronald D. Ciarcia, Southington; Gregory T. DiVincenzo, Plainville, all of Conn.

[73] Assignee: General Electric Company, New York, N.Y.

[21] Appl. No.: 811,857

[22] Filed: Dec. 20, 1985

[51] Int. Cl.[4] ..... H01R 9/22

[52] U.S. Cl. ..... 339/198 R; 339/272 R; 339/22 B; 335/35

[58] Field of Search ..... 339/198 R, 198 G, 198 GA, 339/198 K, 198 H, 22 B, 263 R, 265 F, 270 R, 272 R, 272 A; 335/35

[56] References Cited

U.S. PATENT DOCUMENTS

| | | | |
|---|---|---|---|
| 2,231,325 | 2/1941 | Douglas . | |
| 3,238,495 | 3/1966 | Lanius | 339/198 R |
| 3,354,277 | 11/1967 | Stanback et al. | 339/198 R |
| 3,426,319 | 2/1969 | Downs et al. | 339/198 R |
| 3,715,707 | 2/1973 | Anderson | 339/198 R |
| 4,513,268 | 4/1985 | Seymour et al. | 335/35 |
| 4,609,893 | 9/1986 | Seymour et al. | 333/218 |
| 4,631,634 | 12/1986 | Raabe et al. | 361/358 |

*Primary Examiner*—Gil Weidenfeld
*Assistant Examiner*—Thomas M. Kline
*Attorney, Agent, or Firm*—Richard A. Menelly; Walter C. Bernkopf; Fred Jacob

[57] ABSTRACT

A composite line strap is used with molded case circuit breakers to support the circuit breaker stationary contact and to retain the circuit breaker line terminal screw. The fixed contact is welded to the line strap within the breaker at a first end and the line terminal screw is attached to the opposite end of the line strap by a through-hole in a spring-steel retainer which extends partially within the circuit breaker. The line terminal screw is tightly held within the through-hole of the retainer at the first end and the retainer itself is trapped between the bottom of the circuit breaker case and the line strap at the opposite end of the line strap.

7 Claims, 5 Drawing Figures

CIRCUIT BREAKER LINE TERMINAL SCREW RETAINER

BACKGROUND OF THE INVENTION

The composite line strap of the invention is used within lighting panelboards of the type described within U.S. patent application Ser. No. 705,454, filed Feb. 25, 1985 and entitled "Lighting Circuit Breaker Panelboard Modular Assembly" which application is incorporated herein for purposes of reference. The application describes a plurality of branch circuit breakers assembled in a row on a modular plastic circuit breaker support saddle assembly. The circuit breakers are attached to the plastic support by line terminal screws extending through the circuit breaker line straps into the underlying branch strap conductors. The referenced patent application describes apparatus and procedures for automated assembly of the panelboard components as well as robotic assembly of the circuit breakers to the assembled panelboard. During the automated assembly process, it is essential that the line terminal screws engaging the line terminal straps and the branch conductor straps be restrained from falling between the branch strap conductors during installation since valuable manufacturing time is lost in retrieving and reinserting the terminal screws.

Should such circuit breaker attachment to the lighting panelboard assembly be made at the site of electrical installation, it is important that the line terminal screws be prevented from dropping down within the lighting panelboard interior since the close spacing of the panelboard components makes retrieval a difficult operation.

One purpose of this invention is to provide a composite line terminal strap for molded case circuit breakers which contains both means for retaining the line terminal screw along with means for supporting the circuit breaker stationary contact.

SUMMARY OF THE INVENTION

A composite molded case circuit breaker line terminal strap supports the circuit breaker stationary contact at one end and carries retainer means both internal and external to the breaker for retaining the line terminal screw. The line terminal screw retainer, in turn, becomes trapped between the bottom of the breaker and the end of the line terminal strap.

DESCRIPTION OF THE PREFERRED EMBODIMENT

Figure 1:
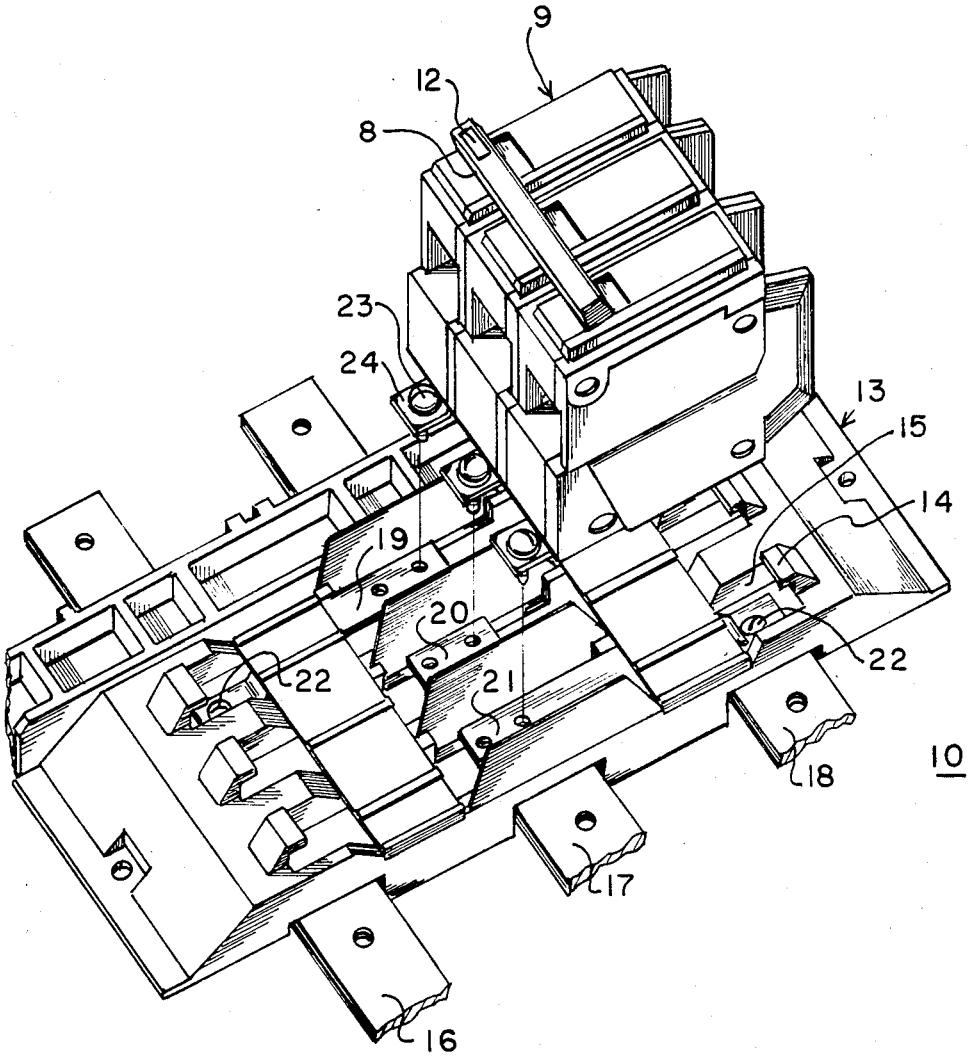
FIG. 1 is a top perspective view of a lighting panelboard assembly with a circuit breaker containing three circuit breaker composite line straps according to the invention in isometric projection therefrom.

A lighting panelboard assembly 10 is shown in FIG. 1 with a three pole molded case branch circuit breaker 9 having operating handles 12 connected together by means of a retainer 8 for operating in unison. The circuit breakers are retained on the assembly by means of circuit breaker hooks 14 integrally formed within a plastic support 13. A plurality of recesses 15 are formed within the plastic support 13 for providing access to the three phase power bus conductors 16–18 located thereunder. The branch circuit breakers are connected to the power buses by means of corresponding branch straps 19–21 which are electrically connected to the buses by means of screws 22. Electrical connection between the branch circuit breakers and the branch straps are made by three composite line straps 24 extending from the bottom surface of the breakers and attached to the branch straps by means of line terminal screws 23. The composite line straps are structured in such a manner that the line terminal screws 23 cannot be completely removed from the composite line straps. The line strap retainers 25, in turn, are trapped between the composite line straps and the branch circuit breakers, as seen by referring now to FIG. 2.

Figure 2:
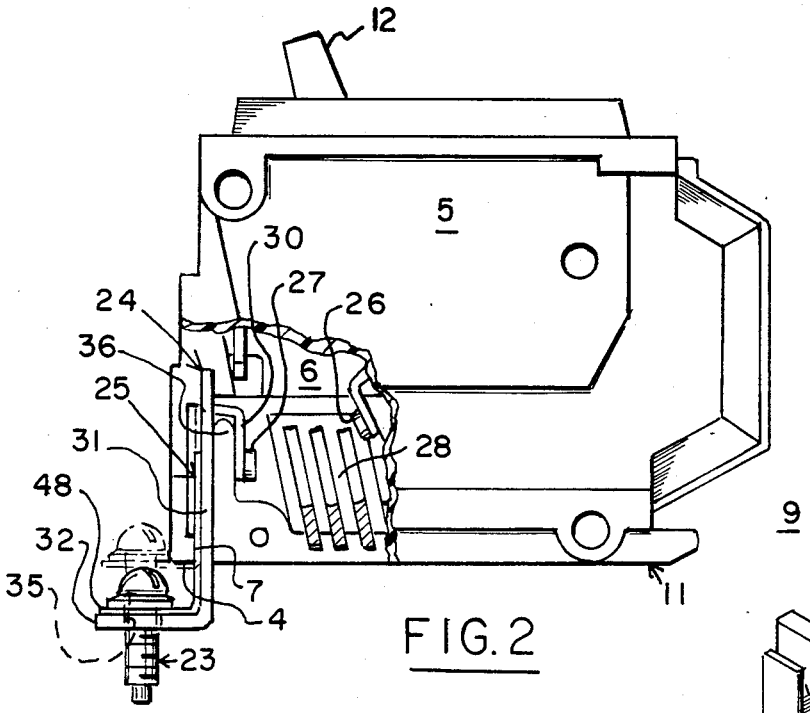
FIG. 2 is a side view of the molded case circuit breaker of FIG. 1 with a portion of the cover removed to show the circuit breaker composite line strap according to the invention.

The circuit breaker 9 shown in FIG. 2 is a molded case residential type circuit breaker used in service entrance load centers that are arranged in a manner similar to the lighting panel assembly of FIG. 1. The composite line strap 24 extends through a slot 7 formed in the bottom of breaker case 11 and consists of a metal plate 31 of good electrical properties such as tin-plated copper. A lanced part 30 is formed on the plate to which circuit breaker stationary contact 27 is attached. An angled bottom part 32, through which a throughhole 35 is formed, provides for the insertion of the line terminal screw 23. The lanced part 30 is arranged around a rib 36 integrally formed with the circuit breaker case and is held between top and bottom circuit breaker side walls 5, 6 in a manner similar to that described within U.S. Pat. No. 4,513,268, which patent is incorporated herein for reference purposes. The arrangement of the composite line strap 24 around rib 36 sets the orientation of the stationary contact 27 with respect to movable contact 26 and the intervening arc chute 28 as indicated. For purposes of fixedly retaining the line terminal screw 23 within the composite line strap 24 a spring-steel retainer 25 is arranged on one side of the composite line strap and extends within the circuit breaker bottom surface slot 7. The angled bottom 48 of the retainer is fixedly held to the branch strap through the angled bottom 32 of the composite line strap by means of the line terminal screw 23. The line terminal screw can be raised and lowered between the angled bottom 32 of the composite line strap and the bottom surface 4 of the case 11 as indicated in phantom for ease in installation and removal of the circuit breaker from the branch strap without dropping the line terminal screw. The line terminal screw when captured within the retainer allows the retainer to move upwards and downwards within the slot 7 for attaching and detaching the circuit breaker without releasing the line terminal screw from the retainer and thereby prevents the line terminal screw from being dropped.

Figure 3:
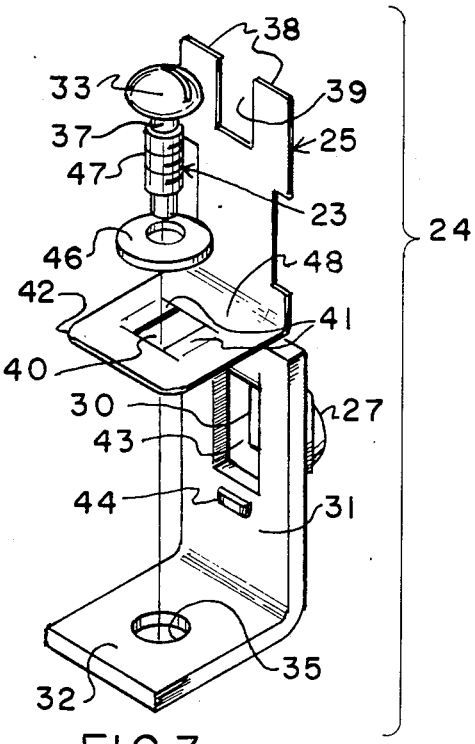
FIG. 3 is a top perspective view in isometric projection of the circuit breaker composite line strap of the invention prior to assembly.

The composite line strap 24 is assembled in the manner depicted in FIG. 3 wherein the line terminal screw 23 is first inserted through a washer 46 and then through a rectangular slot 40 formed through the angled bottom 48 of the retainer 25. Alternatively washer 46 can be attached to the screw before the circumferential ring 37 is formed above the threads 47 and form a part of the screw itself by a different assembly process prior to insertion of the screw within the tabs. A pair of lanced tabs 41 formed on opposing edges of the retainer slot lockingly capture a circumferential ring 37 formed on the terminal screw between the terminal screw head 33 and the threads 47. The retainer 25 has a notch 39 defined within a pair of tabs 38 which notch is coextensive with the slot 43 formed under the lanced part 30 of the metal plate 31 which supports the stationary contact 27. After attaching the line terminal screw 23 to the retainer 25, the line terminal screw thread 47 is inserted within the through-hole 35 formed in the angled bottom part 32 of the metal plate. The through-hole 35 is cut for clearance with respect to the line terminal screw threads 47 to allow the threads to easily rotate while within the through-hole when becoming attached to the threaded circuit breaker branch straps. A boss 44 is formed on one surface of the metal plate to facilitate welding the retainer to the metal plate, if so desired. The edges 42 of the angled bottom part 48 are rounded in order to prevent the bottom plate of one retainer from interfering with the bottom plate of a separate retainer during installation when the circuit breaker is mounted to the branch strap.

Figure 4:
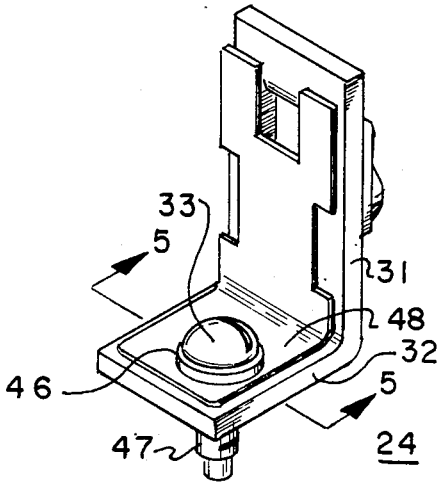
FIG. 4 is a top perspective view of the assembled circuit breaker composite line strap of FIG. 3.

An assembled composite line strap 24 is shown in FIG. 4 with the washer 46 trapped between the terminal screw head 33 and the angled bottom part 48 of the retainer and with the screw threads 47 extending beneath the angled bottom terminal part 32 of the metal plate.

Figure 5:
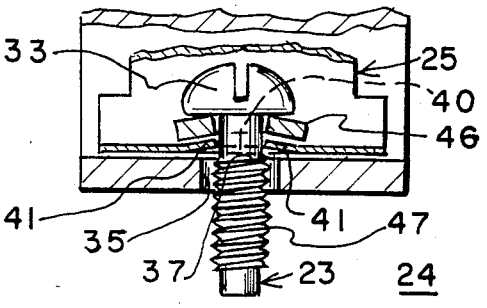
FIG. 5 is a side sectional view of a part of the assembled circuit breaker composite line strap depicted in FIG. 4.

The attachment between the line terminal screw 23 and the retainer 25 is shown in FIG. 5 wherein the metal washer 46 interfaces and is captured between the head 33 of the screw and the lanced tabs 41 on the retainer by passage of the circumferential ring 37 formed on the line terminal screw, through the rectangular slot 40 on the retainer 25 which causes the lanced tabs 41 of the retainer 25 to spring back behind the circumferential ring and trap the ring to the retainer. The line terminal screw cirumferential ring is arranged at a zero pitch and the line terminal screw threads are arranged at a pitch greater than zero for preventing the retainer plate from taking up the line terminal screw threads. The line terminal screw threads 47 can be easily rotated within the through-hole 35 to attach the circuit breaker to the branch strap. The retainer is fabricated from a thin sheet of spring steel to allow for resilience of the tabs and the line terminal screw is fabricated from a hardened steel to insure that the circumferential ring does not wear upon repeated attachment and detachment of the circuit breaker from the line strap. The washer 46 is also fabricated from a spring steel composition to provide spring-clamping action of the electrical joint.

Although the composite line strap of the invention is described for use within a molded case residential circuit breaker, this is by way of example only. The composite line strap of the invention finds application as well within molded case industrial circuit breakers of larger frame size and ampere ratings.

What we claim as new and desire to secure by Letters Patent is as follows:

1. A line terminal strap for a molded case circuit breaker comprising:

an angled metal conductor plate having means at a top end for attaching a contact and means at a bottom end for receiving a headed line terminal screw for attaching said conductor plate to a threaded power bus; and an angled metal retainer plate having a top end and a bottom end superimposed on said conductor plate having means at said bottom end for fixedly engaging said line terminal screw when inserted through said conductor plate receiving means;

said top end of said conductor plate being adapted for retention inside said molded case circuit breaker, said bottom end of said conductor plate and said bottom end of said retainer plate being arranged outside said molded case circuit breaker, said line terminal screw including a plurality of threads for engaging said power bus threads and a circumferential ring formed between said line terminal screw head and said line terminal screw threads, said retainer plate engaging means surrounds and engages said circumferential ring after said terminal screw threads have passed therethrough whereby said terminal screw is retained on said retainer plate.

2. The line terminal strap for a molded case circuit breaker of laim 1 further including a metal washer intermediate said line terminal screw head and said retainer plate for allowing rotation of said line terminal screw head without contacting said retainer plate.

3. The line terminal strap for a molded case circuit breaker of claim 1 wherein said retainer plate engaging means comprises a slot formed through said bottom end and including a pair of lanced tabs on opposite sides of said slot.

4. The line terminal strap for a molded case circuit breaker of claim 1 wherein said retainer plate comprises spring steel.

5. The line terminal strap for a molded case circuit breaker of claim 1 wherein said conductor plate top end is perpendicular to said conductor plate bottom end.

6. The line terminal strap for a molded case circuit breaker of claim 3 wherein a length measured between said retainer plate slot tabs is less than a diameter measured across said circumferential ring whereby said tabs frictionally engage said circumferential ring.

7. The line terminal strap for a molded case circuit breaker of claim 1 wherein said line terminal screw circumferential ring is arranged at a zero pitch and said line terminal screw threads are arranged at a pitch greater than zero for preventing said retainer plate from taking up said line terminal screw threads.

* * * * *